US010381806B2

(12) United States Patent
Yasunaka et al.

(10) Patent No.: US 10,381,806 B2
(45) Date of Patent: Aug. 13, 2019

(54) ESD PROTECTION DEVICE AND MANUFACTURING METHOD FOR SAME

(71) Applicant: Murata Manufacturing Co., Ltd., Nagaokakyo-shi, Kyoto-fu (JP)

(72) Inventors: Katsumi Yasunaka, Nagaokakyo (JP); Jun Adachi, Nagaokakyo (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 238 days.

(21) Appl. No.: 15/591,223

(22) Filed: May 10, 2017

(65) Prior Publication Data

US 2017/0244223 A1 Aug. 24, 2017

Related U.S. Application Data

(63) Continuation of application No. PCT/JP2015/084241, filed on Dec. 7, 2015.

(30) Foreign Application Priority Data

Dec. 18, 2014 (JP) ..... 2014-256648

(51) Int. Cl.
*H01T 1/20* (2006.01)
*H01T 4/12* (2006.01)
*H01T 21/00* (2006.01)

(52) U.S. Cl.
CPC ..... *H01T 1/20* (2013.01); *H01T 4/12* (2013.01); *H01T 21/00* (2013.01)

(58) Field of Classification Search
CPC ..... H01T 1/20; H01T 4/12; H01T 21/00
(Continued)

(56) References Cited

U.S. PATENT DOCUMENTS

2010/0309595 A1* 12/2010 Adachi ..... H01T 1/20 361/56
2011/0026186 A1* 2/2011 Katsumura ..... H01T 1/24 361/212

(Continued)

FOREIGN PATENT DOCUMENTS

JP 03-163778 A 7/1991
JP 2007-227259 A 9/2007

(Continued)

OTHER PUBLICATIONS

Machine translation of Sato et al. Japanese Patent Document JP H03-163778 A, Jul. 15, 1991 (Year: 1991).*

(Continued)

*Primary Examiner* — Kevin J Comber
(74) *Attorney, Agent, or Firm* — Keating & Bennett, LLP

(57) ABSTRACT

An ESD protection device includes a bare unitary body, and a first discharge electrode and a second discharge electrode that are disposed inside the bare unitary body. The first discharge electrode and the second discharge electrode are opposed to each other with a gap interposed therebetween. The bare unitary body includes a cavity in which the gap between the first discharge electrode and the second discharge electrode is located, and to which the first discharge electrode and the second discharge electrode are exposed. A first space of the cavity on a side closer to the first discharge electrode is smaller than a second space of the cavity on a side closer to the second discharge electrode.

18 Claims, 17 Drawing Sheets

(58) Field of Classification Search
USPC ..... 361/112
See application file for complete search history.

(56) References Cited

U.S. PATENT DOCUMENTS

| | | | |
|---|---|---|---|
| 2013/0077199 | A1 | 3/2013 | Ikeda |
| 2015/0263489 | A1 | 9/2015 | Otsubo et al. |

FOREIGN PATENT DOCUMENTS

| | | | |
|---|---|---|---|
| JP | 2007-234372 | A | 9/2007 |
| JP | 2011-124102 | A | 6/2011 |
| JP | 2013-168226 | A | 8/2013 |
| WO | 2011/145598 | A1 | 11/2011 |
| WO | 2014/098084 | A1 | 6/2014 |

OTHER PUBLICATIONS

Official Communication issued in International Patent Application No. PCT/JP2015/084241, dated Mar. 1, 2016.

* cited by examiner

ESD PROTECTION DEVICE AND MANUFACTURING METHOD FOR SAME

CROSS REFERENCE TO RELATED APPLICATIONS

This application claims the benefit of priority to Japanese Patent Application No. 2014-256648 filed on Dec. 18, 2014 and is a Continuation application of PCT Application No. PCT/JP2015/084241 filed on Dec. 7, 2015. The entire contents of each application are hereby incorporated herein by reference.

BACKGROUND OF THE INVENTION

1. Field of the Invention

The present invention relates to an ESD protection device and a manufacturing method for the ESD protection device.

2. Description of the Related Art

An ESD protection device has been proposed in Japanese Unexamined Patent Application Publication No. 2013-168226, for example. The proposed ESD protection device includes a bare unitary body made of ceramic, and a first discharge electrode and a second discharge electrode that are disposed inside the bare unitary body. The first discharge electrode and the second discharge electrode are opposed to each other with a gap interposed therebetween. The bare unitary body includes a dome-like cavity in which the gap is positioned.

SUMMARY OF THE INVENTION

Higher ESD protection characteristics of an ESD protection device are obtained at a lower discharge start voltage. The inventor of the present invention discovered that the discharge start voltage depends on the shape of the cavity in the bare unitary body. More specifically, when the cavity has the dome shape as in the ESD protection device of the related art, the cavity has a symmetric shape between the first discharge electrode side and the second discharge electrode side, and the cavity has the same size on both the sides. The inventor of the present invention discovered that, in the above-described case, the discharge start voltage is not reduced because an electric field in the cavity is generated as a uniform electric field on both the first discharge electrode side and the second discharge electrode side.

On the basis of the above discoveries, preferred embodiments of the present invention provide an ESD protection device in which the discharge start voltage is significantly reduced and the ESD protection characteristics are significantly improved, and also provide a manufacturing method for the ESD protection device.

An ESD protection device according to a preferred embodiment of the present invention includes a bare unitary body and a first discharge electrode and a second discharge electrode that are disposed inside the bare unitary body. The first discharge electrode and the second discharge electrode are opposed to each other with a gap interposed therebetween, the bare unitary body includes a cavity in which the gap between the first discharge electrode and the second discharge electrode is located, and to which the first discharge electrode and the second discharge electrode are exposed, and a first space of the cavity on a side closer to the first discharge electrode is smaller than a second space of the cavity on a side closer to the second discharge electrode.

With the ESD protection device according to the preferred embodiment of the present invention described above, since the first space on the side closer to the first discharge electrode is smaller than the second space on the side closer to the second discharge electrode, a degree of concentration of an electric field in the first space is larger than a degree of concentration of an electric field in the second space. Therefore, when the first discharge electrode is electrically connected to the primary side (plus side) and the second discharge electrode is electrically connected to the secondary side (ground side), the electric field in the cavity is generated as a non-uniform electric field between the first space and the second space. Thus, the degree of concentration of the electric field in the first space is increased, and partial discharge is more likely to occur near the first space. Hence, an electron avalanche is generated successively starting from the partial discharge, thus causing disruptive discharge. In the preferred embodiment of the present invention described above, therefore, the partial discharge occurs at a lower voltage than in the related art, and consequently a start voltage of the disruptive discharge between the first discharge electrode and the second discharge electrode is significantly reduced.

In an ESD protection device according to a preferred embodiment of the present invention, a length of the first space in a height direction of the bare unitary body is smaller than a length of the second space in the height direction of the bare unitary body. Here, the length in the height direction refers to an average length in the height direction.

With the ESD protection device according to the preferred embodiment of the present invention described above, since the length of the first space in the height direction of the bare unitary body is smaller than the length of the second space in the height direction of the bare unitary body, the first space is able to be made smaller than the second space with a simple configuration.

In an ESD protection device according to a preferred embodiment of the present invention, a degree of concentration of an electric field in the first space is larger than a degree of concentration of an electric field in the second space.

With the ESD protection device according to the preferred embodiment of the present invention described above, since the degree of concentration of the electric field in the first space is larger than the degree of concentration of the electric field in the second space, the start voltage of the disruptive discharge between the first discharge electrode and the second discharge electrode is significantly reduced.

In an ESD protection device according to a preferred embodiment of the present invention, in a vertical section extending in a direction in which the first discharge electrode and the second discharge electrode are opposed to each other and in the height direction of the bare unitary body, a sectional area of the first space surrounded by an inner surface of the cavity, an outer surface of the first discharge electrode, and by a first linear line that contacts an end portion of the first discharge electrode on the side closer to the second discharge electrode and that extends in the height direction, is smaller than a sectional area of the second space surrounded by the inner surface of the cavity, an outer surface of the second discharge electrode, and by a second linear line that contacts an end portion of the second discharge electrode on the side closer to the first discharge electrode and that extends in the height direction.

With the ESD protection device according to the preferred embodiment of the present invention described above, since, in the above-mentioned vertical section, the sectional area of the first space is smaller than the sectional area of the second space, the first space is able to be made smaller than the second space. As a result, the degree of concentration of the electric field in the first space is able to be increased, and the discharge start voltage is able to be significantly reduced.

In an ESD protection device according to a preferred embodiment of the present invention, in the above-mentioned vertical section, a first angle defined by the inner surface of the cavity and the outer surface of the first discharge electrode is smaller than a second angle defined by the inner surface of the cavity and the outer surface of the second discharge electrode.

With the ESD protection device according to the preferred embodiment of the present invention described above, in the above-mentioned vertical section, the first angle defined by the inner surface of the cavity and the outer surface of the first discharge electrode is smaller than the second angle defined by the inner surface of the cavity and the outer surface of the second discharge electrode. Therefore, the sectional area of the first space is able to be made even smaller than the sectional area of the second space. As a result, the degree of concentration of the electric field in the first space is able to be further increased, and the discharge start voltage is able to be further significantly reduced.

In an ESD protection device according to a preferred embodiment of the present invention, the first angle is an acute angle, and the second angle is about 90° or an obtuse angle, for example.

With the ESD protection device according to the preferred embodiment of the present invention described above, the first angle is an acute angle, and the second angle is about 90° or an obtuse angle, for example. Therefore, the sectional area of the first space is able to be made even smaller than the sectional area of the second space, and the discharge start voltage is able to be further significantly reduced.

In an ESD protection device according to a preferred embodiment of the present invention, the bare unitary body includes a first portion in which the cavity is located, and a second portion which is joined with the first portion and in which the first discharge electrode and the second discharge electrode are disposed, and a level difference interface is provided at a joined boundary between the first portion and the second portion.

With the ESD protection device according to the preferred embodiment of the present invention described above, the bare unitary body includes the first portion and the second portion, and the level difference interface is provided at the joined boundary between the first portion and the second portion. Thus, the bare unitary body is able to be provided by manufacturing the first portion and the second portion separately, and then joining the first portion and the second portion with each other. As a result, the first portion in which the cavity is located is able to be manufactured differently from the second portion, and the cavity with a desired shape is able to be formed by an appropriate method.

A manufacturing method for an ESD protection device according to a preferred embodiment of the present invention includes steps of preparing a first multilayer body by forming holes with a same or substantially a same shape in a plurality of first ceramic sheets, and by laminating the plurality of first ceramic sheets in a state that the holes in the laminated first ceramic sheets are aligned or substantially aligned with one another to form a cavity; preparing a second multilayer body by laminating a plurality of second ceramic sheets, a first discharge electrode, and a second discharge electrode; forming a third multilayer body by placing one of the first multilayer body and the second multilayer body above the other in a state that a laminating direction of the first multilayer body and a laminating direction of the second multilayer body are different from each other, and that the first discharge electrode and the second discharge electrode are positioned to face the cavity; and firing the third multilayer body.

With the manufacturing method for the ESD protection device according to the preferred embodiment of the present invention described above, the first multilayer body is prepared by forming the holes with the same or substantially the same shape in the plurality of first ceramic sheets, and by laminating the plurality of first ceramic sheets in the state that the holes in the laminated first ceramic sheets are aligned or substantially aligned with one another to form the cavity. As a result, the cavity is able to be formed in a shape with a smooth inner surface in the laminating direction of the first multilayer body. In addition, it is possible to simply form the cavity with a size that is asymmetric between one side and the other side in a direction perpendicular or substantially perpendicular to the laminating direction of the first multilayer body.

Furthermore, the third multilayer body preferably is formed by placing one of the first multilayer body and the second multilayer body above the other in the state that the laminating direction of the first multilayer body and the laminating direction of the second multilayer body are different from each other, and that the first discharge electrode and the second discharge electrode are positioned to face the cavity. As a result, a space on the side closer to the first discharge electrode and a space on the side closer to the second discharge electrode are able to be easily made different from each other.

With the ESD protection devices and the manufacturing methods for the ESD protection devices according to the preferred embodiments of the present invention, the discharge start voltage is significantly reduced and the ESD protection characteristics are significantly improved.

The above and other elements, features, steps, characteristics and advantages of the present invention will become more apparent from the following detailed description of the preferred embodiments of the present invention with reference to the attached drawings.

DETAILED DESCRIPTION OF THE PREFERRED EMBODIMENTS

The present invention will be described below in connection with specific preferred embodiments. It is to be noted that the preferred embodiments of the present invention described in this specification are merely examples, and that the configurations in the preferred embodiments of the present invention are able to be partly replaced or combined between different preferred embodiments of the present invention.

First Preferred Embodiment

Figure 1:
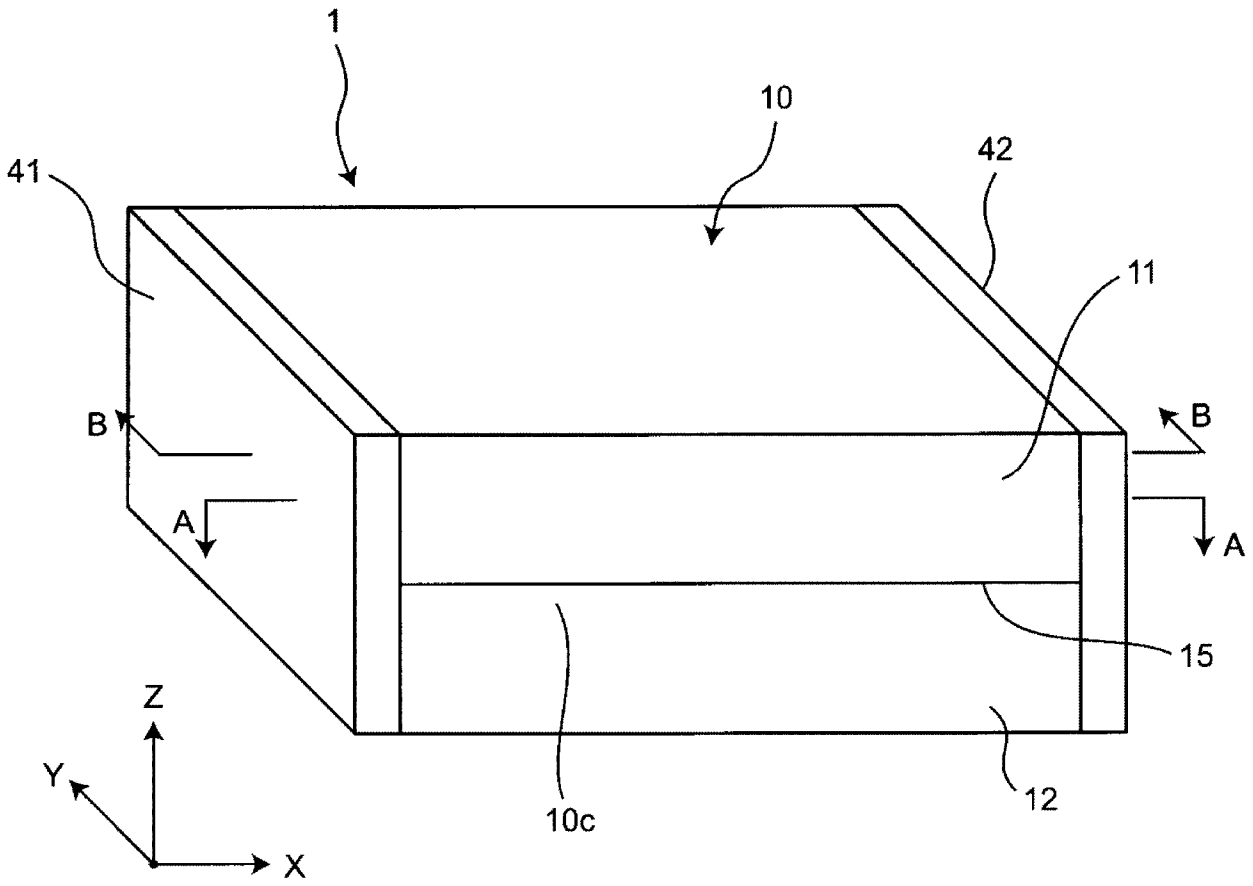
FIG. 1 is a perspective view showing an ESD protection device according to a first preferred embodiment of the present invention.
Figure 2:
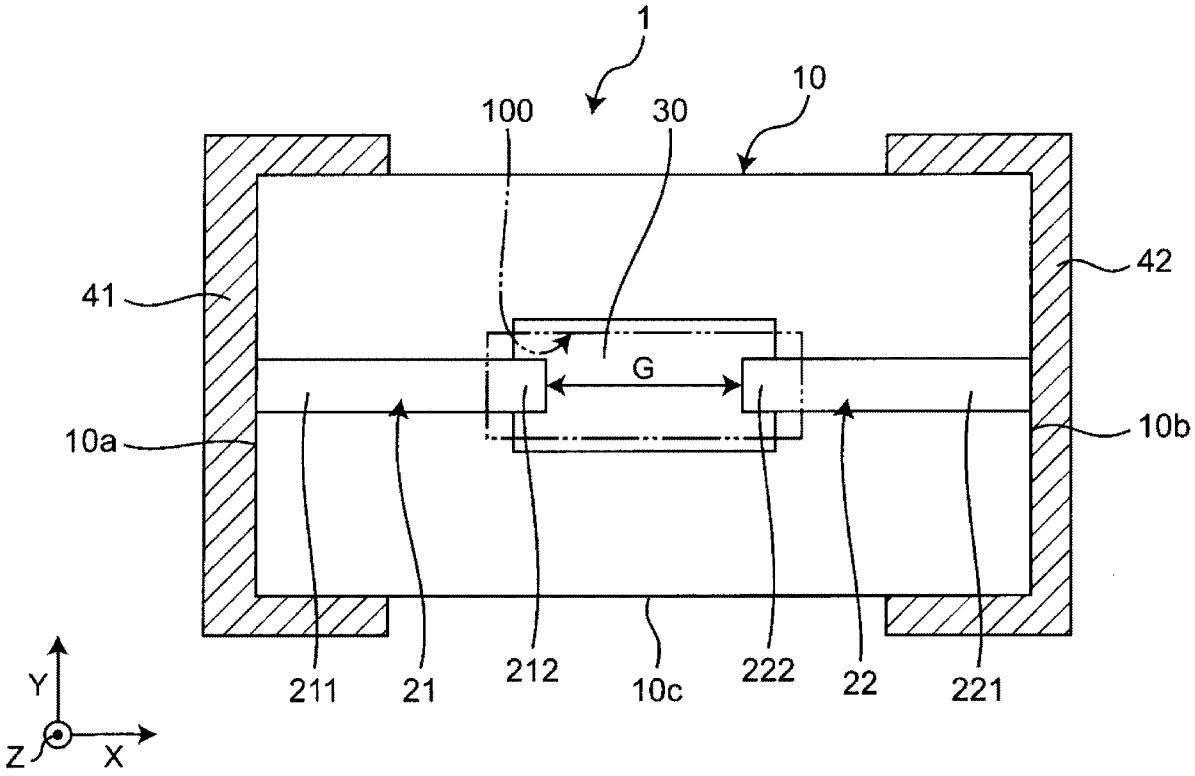
FIG. 2 is a sectional view taken along a line A-A in FIG. 1.
Figure 3:
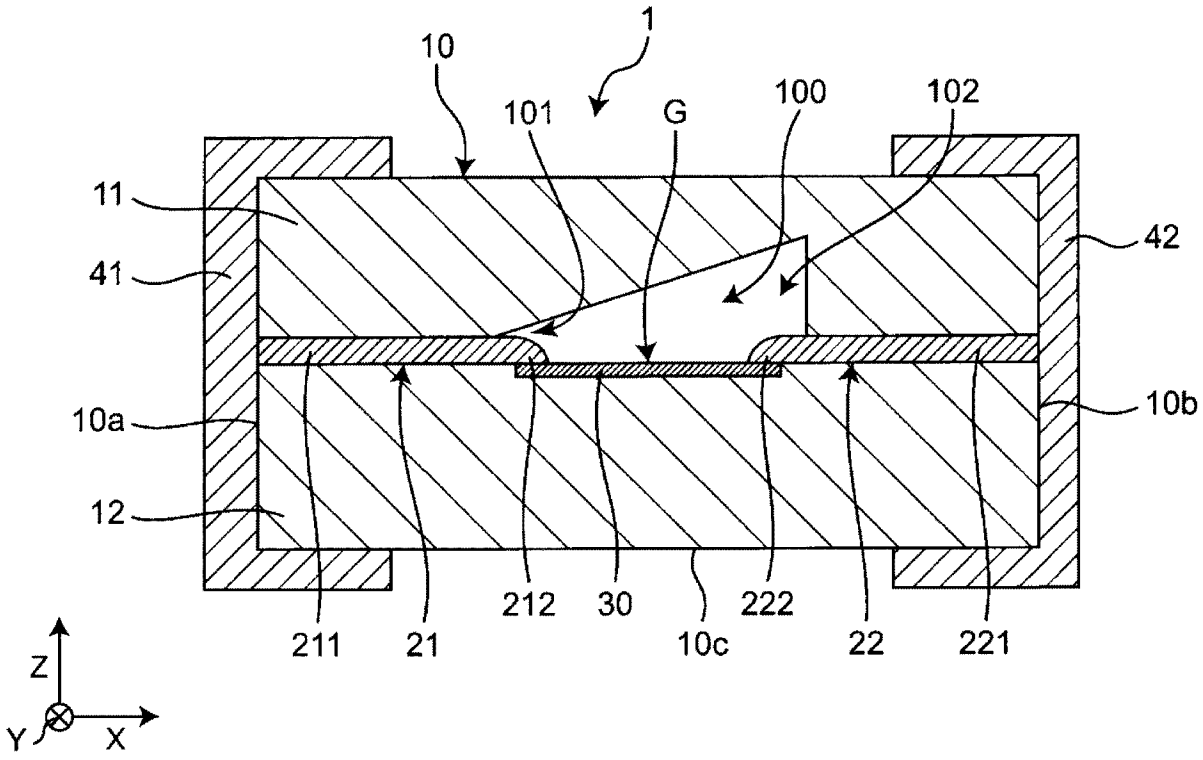
FIG. 3 is a sectional view taken along a line B-B in FIG. 1.

FIG. 1 is a perspective view showing an ESD protection device according to a first preferred embodiment of the present invention. FIG. 2 is a sectional view taken along a line A-A in FIG. 1. FIG. 3 is a sectional view taken along a line B-B in FIG. 1. As shown in FIGS. 1, 2 and 3, an ESD (Electro-Static Discharge) protection device 1 includes a bare unitary body 10, a first discharge electrode 21, a second discharge electrode 22, and a discharge auxiliary electrode 30 that are all disposed inside the bare unitary body 10, and a first outer electrode 41 and a second outer electrode 42 that are disposed on an outer surface of the bare unitary body 10.

The bare unitary body 10 preferably has a rectangular parallelepiped or substantially rectangular parallelepiped shape, and it has a length, a width, and a height. A direction of the length of the bare unitary body 10 is defined as an X direction, a direction of the width of the bare unitary body 10 is defined as a Y direction, and a direction of the height of the bare unitary body 10 is defined as a Z direction. The outer surface of the bare unitary body 10 includes a first end surface 10*a*, a second end surface 10*b* positioned on the opposite side to the first end surface 10*a*, and a peripheral surface 10*c* positioned between the first end surface 10*a* and the second end surface 10*b*. The first end surface 10*a* and the second end surface 10*b* are spaced apart from each other in the X direction.

The first discharge electrode 21 and the second discharge electrode 22 are disposed inside the bare unitary body 10 at the same or substantially the same height. One end of the first discharge electrode 21 and one end of the second discharge electrode 22 are opposed to each other with a gap G interposed therebetween. A direction in which the first discharge electrode 21 and the second discharge electrode 22 are opposed to each other is aligned or substantially aligned with the X-direction. The first discharge electrode 21 is electrically connected to the first outer electrode 41, and the second discharge electrode 22 is electrically connected to the second outer electrode 42.

The discharge auxiliary electrode 30 electrically connects the first discharge electrode 21 and the second discharge electrode 22 to each other, and it is positioned to face the gap G. The bare unitary body 10 includes a cavity 100 in which the gap G is positioned. A portion of the first discharge electrode 21 that opposes the second discharge electrode 22 and a portion of the second discharge electrode 22 that opposes the first discharge electrode 21 are exposed to the cavity 100.

A first space 101 of the cavity 100 on the side closer to the first discharge electrode 21 is smaller than a second space 102 of the cavity 100 on the side closer to the second discharge electrode 22. A degree of concentration of an electric field in the first space 101 is larger than a degree of concentration of an electric field in the second space 102. More specifically, a size (length) of the first space 101 in the X direction is smaller than a size (length) of the second space 102 in the X direction, and/or a size (length) of the first space 101 in the Y direction is smaller than a size (length) of the second space 102 in the Y direction, and/or a size (length) of the first space 101 in the Z direction is smaller than a size (length) of the second space 102 in the Z direction. Here, the sizes in the X, Y and Z directions represent respective average sizes in the X, Y and Z directions, respectively. The first space 101 is able to be made smaller than the second space 102 by individually adjusting the sizes in the X, Y and Z directions as desired.

The ESD protection device 1 is included in an electronic device, for example, to discharge static electricity generated in the electronic device and to significantly reduce or prevent damage of the electronic device, which may be caused due to the static electricity. More specifically, when the first outer electrode 41 is electrically connected to a terminal of the electronic device and the second outer electrode 42 is electrically connected to ground, the static electricity in the electronic device is transferred from the first outer electrode 41 and the first discharge electrode 21 to the second discharge electrode 22 and the second outer electrode 42.

There are two types of discharge of static electricity, which occurs from the first discharge electrode 21 toward the second discharge electrode 22, including aerial discharge and discharge via the discharge auxiliary electrode 30. The aerial discharge is discharge propagating across the cavity 100. The discharge via the discharge auxiliary electrode 30 is generated as discharge (creeping discharge) due to a current flowing along a surface of the discharge auxiliary electrode 30, and discharge due to a current flowing through the inside of the discharge auxiliary electrode 30.

In the above-described ESD protection device 1, since the first space 101 of the cavity 100 on the side closer to the first discharge electrode 21 is smaller than the second space 102 of the cavity 100 on the side closer to the second discharge electrode 22, the degree of concentration of the electric field in the first space 101 is larger than the degree of concentration of an electric field in the second space 102. Accordingly, when discharge occurs in the cavity 100 from the first discharge electrode 21 toward the second discharge electrode 22, the electric field in the cavity 100 is generated as a non-uniform electric field between the first space 101 and the second space 102. Thus, the degree of concentration of the electric field in the first space 101 is increased, and partial discharge is more likely to occur near the first space 101. Therefore, an electron avalanche is generated successively starting from the partial discharge, thus causing a disruptive discharge. In the first preferred embodiment, therefore, the partial discharge occurs at a lower voltage than in the related art, and, accordingly, a start voltage of the disruptive discharge between the first discharge electrode 21 and the second discharge electrode 22 is able to be significantly reduced. The bare unitary body 10 preferably has a high dielectric constant to increase the concentration of the electric field in the first space 101.

The bare unitary body 10 is preferably provided by laminating a plurality of ceramic layers, and then firing the ceramic layers. More specifically, the bare unitary body 10 includes a first portion 11 in which the cavity 100 is located, and a second portion 12 which is joined with the first portion 11 and in which the first discharge electrode 21 and the second discharge electrode 22 are disposed. The first portion 11 is provided by ceramic layers that are laminated in the Y direction and then fired. The second portion 12 is provided by ceramic layers that are laminated in the Z direction and then fired.

A level difference interface 15 is formed at a joined boundary between the first portion 11 and the second portion 12, because the bare unitary body 10 is provided by manufacturing the first portion 11 and the second portion 12 separately, and then joining the first portion 11 and the second portion 12 with each other. Thus, since the first portion 11, in which the cavity 100 is formed, and the second portion 12 are able to be manufactured differently, the cavity 100 with a desired shape is able to be formed as desired.

The ceramic layers each include, for example, LTCC (Low Temperature Co-fired Ceramics) including Ba, Al, and Si as main components. The ceramic layers may include at least one of an alkali metal component and a boron component, or may include a glass component.

The first discharge electrode 21 and the second discharge electrode 22 are each formed in a strip shape extending in the X direction. The first discharge electrode 21 and the second discharge electrode 22 are arranged in an opposing relation in the X direction. The first discharge electrode 21 and the second discharge electrode 22 include, for example, Cu, Ag, Pd, Pt, Al, Ni, W, or an alloy including at least one of those elements.

A first end portion 211 of the first discharge electrode 21 in a lengthwise direction thereof is exposed at the first end surface 10*a* of the bare unitary body 10. A second end portion 212 of the first discharge electrode 21 in the lengthwise direction is positioned inside the bare unitary body 10. A first end portion 221 of the second discharge electrode 22 in a lengthwise direction thereof is exposed at the second end surface 10*b* of the bare unitary body 10. A second end portion 222 of the second discharge electrode 22 in the lengthwise direction is positioned inside the bare unitary body 10. The second end portion 212 of the first discharge electrode 21 and the second end portion 222 of the second discharge electrode 22 are opposed to each other with the gap G interposed therebetween.

The discharge auxiliary electrode 30 is positioned under the gap G, and the gap G at least partially overlaps the discharge auxiliary electrode 30 when viewed from the Z direction. The discharge auxiliary electrode 30 preferably has a rectangular or substantially rectangular shape when viewed from the Z direction. The discharge auxiliary electrode 30 electrically connects the second end portion 212 of the first discharge electrode 21 and the second end portion 222 of the second discharge electrode 22 to each other.

The discharge auxiliary electrode 30 includes, for example, a mixture of a conductive material and an insulating material. The conductive material may be, for example, Cu, Ag, Pd, Pt, Al, Ni, W, or a combination any of those elements. Alternatively, the conductive material may include another material, for example, a semiconductor material such as an SiC powder or a resistance material with lower conductivity than a metal material. The semiconductor material may be, for example, a metal semiconductor (for example, Si or Ge), a carbide (for example, SiC, TiC, ZrC, or WC), a nitride (for example, TiN, ZrN, chromium nitride, VN, or TaN), a silicide (for example, titanium silicide, zirconium silicide, tungsten silicide, molybdenum silicide, or chromium silicide), a boride (for example, titanium boride, zirconium boride, chromium boride, lanthanum boride, molybdenum boride, or tungsten boride), or an oxide (for example, strontium titanate). Two or more among the above-mentioned materials may be mixed as desired to form the semiconductor material. In addition, the conductive material may be coated with an inorganic material. The inorganic material is not limited to a particular material, and may be, for example, an ordinary inorganic material (for example, $Al_2O_3$, $ZrO_2$, or $SiO_2$), or a mixed calcined powder that is a material with a ceramic base material. The insulating material may be, for example, an oxide (for example, $Al_2O_3$, $SiO_2$, $ZrO_2$, or $TiO_2$), a nitride (for example, $Si_3N_4$ or AlN), the mixed calcined powder that is a material with the ceramic base material, a vitreous substance, or a combination of any of the above-mentioned materials.

The first outer electrode 41 covers not only the entire first end surface 10*a*, but also an end portion of the peripheral surface 10*c* on the side closer to the first end surface 10*a*. The first outer electrode 41 is in contact with the first end portion 211 of the first discharge electrode 21 to provide an electrical connection therebetween. The second outer electrode 42 covers not only the entire second end surface 10*b*, but also an end portion of the peripheral surface 10*c* on the side closer to the second end surface 10*b*. The second outer electrode 42 is in contact with the first end portion 221 of the second discharge electrode 22 to provide an electrical connection therebetween. The first outer electrode 41 and the second outer electrode 42 include, for example, Cu, Ag, Pd, Pt, Al, Ni, W, or an alloy including at least one of those elements.

The cavity 100 includes an inner surface preferably with a shape that is rectangular or substantially rectangular and that is in an overlapped relation to the discharge auxiliary electrode 30 when viewed from the Z direction. More specifically, a size of the cavity 100 in the Y direction is the same or substantially the same as a size of the discharge auxiliary electrode 30 in the Y direction. A size of the cavity 100 in the X direction is larger than a size of the discharge auxiliary electrode 30 in the X direction, and the cavity 100 overlaps the second end portion 212 of the first discharge electrode 21 and the second end portion 222 of the second discharge electrode 22. Furthermore, the inner surface of the cavity 100 preferably a triangular or substantially triangular shape when viewed in the XZ section. Thus, the inner surface of the cavity 100 preferably has the shape of a triangular or substantially triangular prism.

Figure 4:
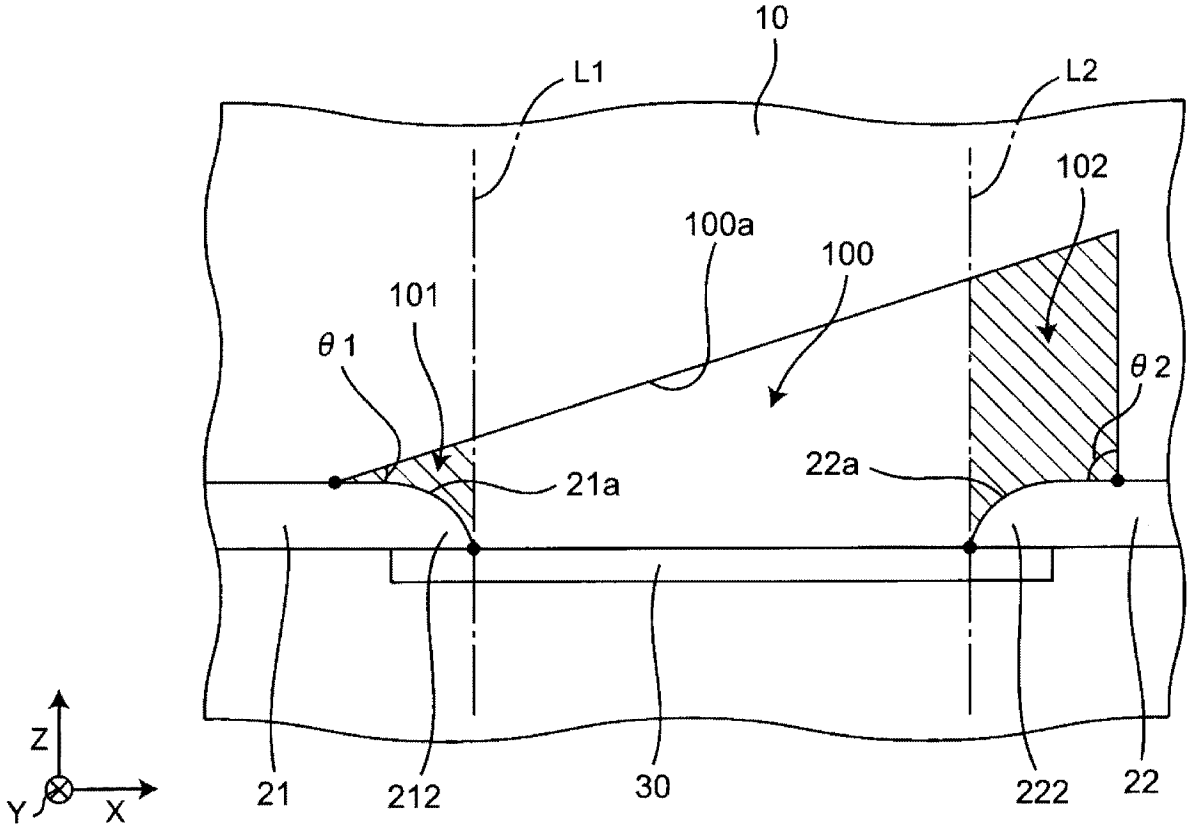
FIG. 4 is an enlarged sectional view of a cavity of the ESD protection device shown in FIG. 1.

FIG. 4 is an enlarged sectional view of the cavity 100. As shown in FIG. 4, in a vertical section (XZ section) extending in the opposing direction (X direction) of the first discharge electrode 21 and the second discharge electrode 22 and in the height direction (Z direction) of the bare unitary body 10, the first space 101 is a space surrounded by an inner surface 100*a* of the cavity 100, an outer surface 21*a* of the first discharge electrode 21, and a first linear line L1 contacting the second end portion 212 of the first discharge electrode 21 and extending in the height direction. The second space 102 is a space surrounded by the inner surface 100*a* of the cavity 100, an outer surface 22*a* of the second discharge electrode 22, and a second linear line L2 contacting the second end portion 222 of the second discharge electrode 22 and extending in the height direction. For easier understanding, the first space 101 and the second space 102 are denoted by hatching in FIG. 4.

A sectional area of the first space 101 is smaller than a sectional area of the second space 102. More specifically, a first angle θ1 defined by the inner surface 100*a* of the cavity 100 and the outer surface 21*a* of the first discharge electrode 21 is smaller than a second angle θ2 defined by the inner surface 100*a* of the cavity 100 and the outer surface 22*a* of the second discharge electrode 22. For example, the first angle θ1 is an acute angle, and the second angle θ2 is about 90°.

Thus, since the first angle θ1 is smaller than the second angle θ2, the sectional area of the first space 101 is able to be made even smaller than the sectional area of the second space 102. As a result, the degree of concentration of the electric field in the first space 101 is able to be further increased, and the discharge start voltage is able to be further significantly reduced. Moreover, since the first angle θ1 is an acute angle and the second angle θ2 is about 90°, the sectional area of the first space 101 is able to be made even smaller than the sectional area of the second space 102, and the discharge start voltage is able to be further significantly reduced.

The size of the first space 101 in the X direction may be smaller than the size of the second space 102 in the X direction, for example. In addition or alternatively, the size of the first space 101 in the Z direction may be smaller than the size the second space 102 in the Z direction.

A manufacturing method for the ESD protection device 1 is described below.

Figure 5A:
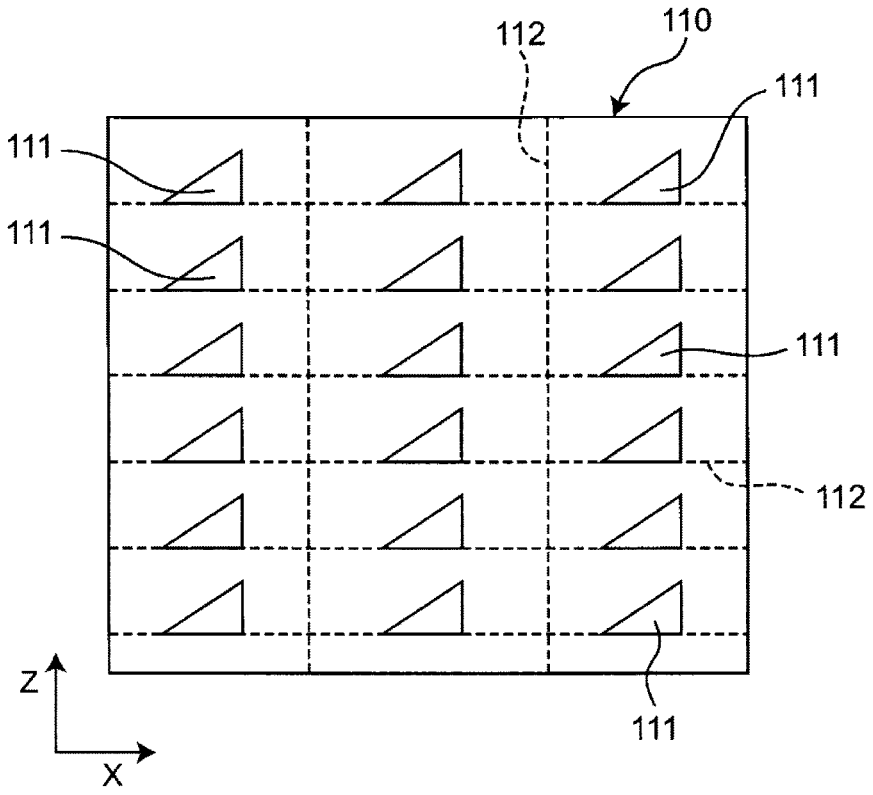
FIGS. 5A and 5B are explanatory views referenced to explain a manufacturing method for the ESD protection device shown in FIG. 1.
Figure 5B:
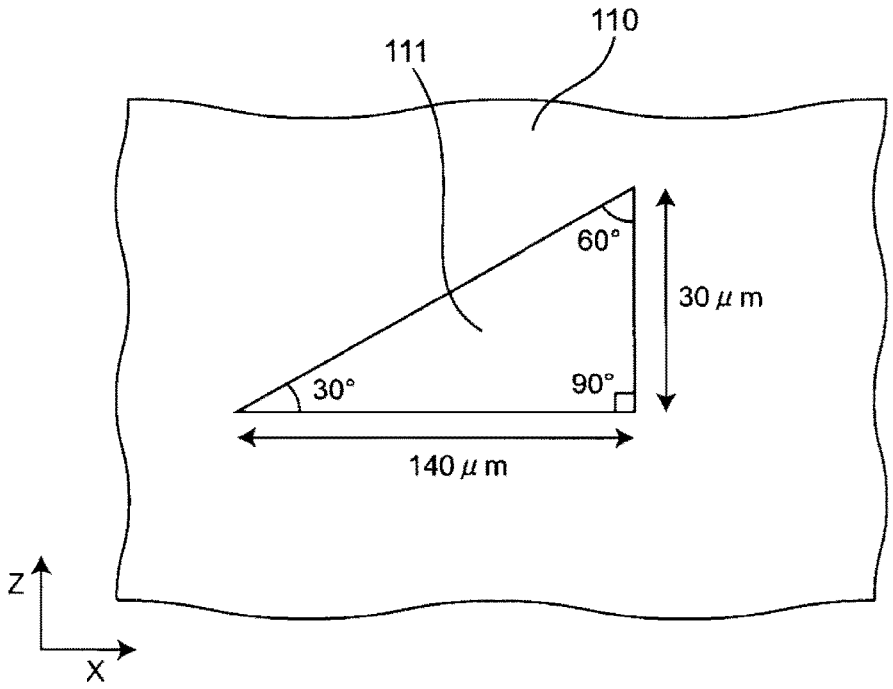

As shown in FIG. 5A, a plurality of holes 111 with the same or substantially the same shape are formed in a first ceramic sheet 110. A cut line 112 is formed between adjacent two of the holes 111. The cut line 112 may be a physical cut in the first ceramic sheet 110, or may be virtually formed on the first ceramic sheet 110 without the first ceramic sheet 110 being actually cut. The position of the cut line 112 corresponds to a size of each ESD protection device 1 (per chip). In other words, the holes 111 are formed in the single ceramic sheet 110 corresponding to each of a plurality of chips. The holes 111 are each formed by punching the first ceramic sheet 110 with a die. As shown in FIG. 5B, the hole 111 preferably has a triangular or substantially triangular shape corresponding to the shape of the cavity 100 in the XZ section. In an example, a size of the hole 111 in the Z direction is about 30 μm, and a size of the hole 111 in the X direction is about 140 μm. Inner angles of the hole 111 are about 30°, about 60°, and about 90°.

Figure 6A:
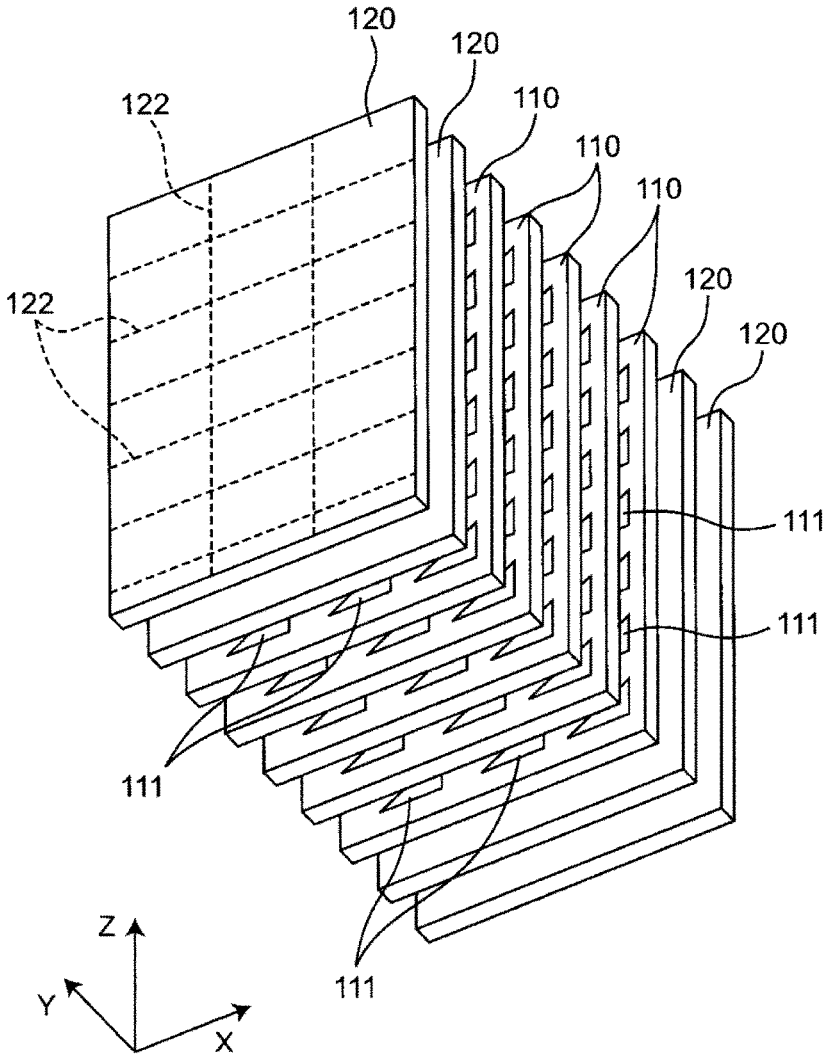
FIGS. 6A-6F are explanatory views referenced to explain the manufacturing method for the ESD protection device shown in FIG. 1.
Figure 6B:
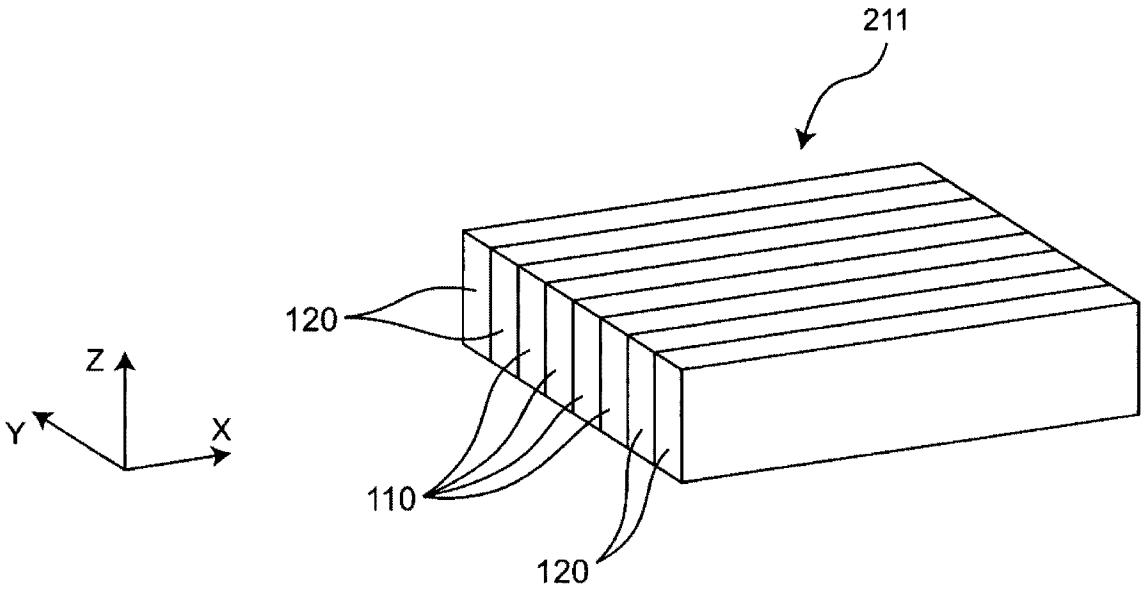

Thereafter, as shown in FIG. 6A, the plurality of first ceramic sheets 110 are laminated, with the holes 111 in the laminated first ceramic sheets 110 aligned or substantially aligned with one another to form the cavity 100. The plurality of first ceramic sheets 110 are laminated in the Y direction. The plurality of first ceramic sheets 110 are then sandwiched by second ceramic sheets 120, each of which does not include the holes 111, from the Y direction. Moreover, cut lines 122 are formed in each of the second ceramic sheets 120. By cutting the first and second ceramic sheets along the cut lines 112 and 122, a first multilayer body 211 with a size corresponding to a size of each chip is prepared as shown in FIG. 6B. A laminating direction of the first multilayer body 211 including the first and second ceramic sheets 110 and 120 is the Y direction.

Figure 6C:
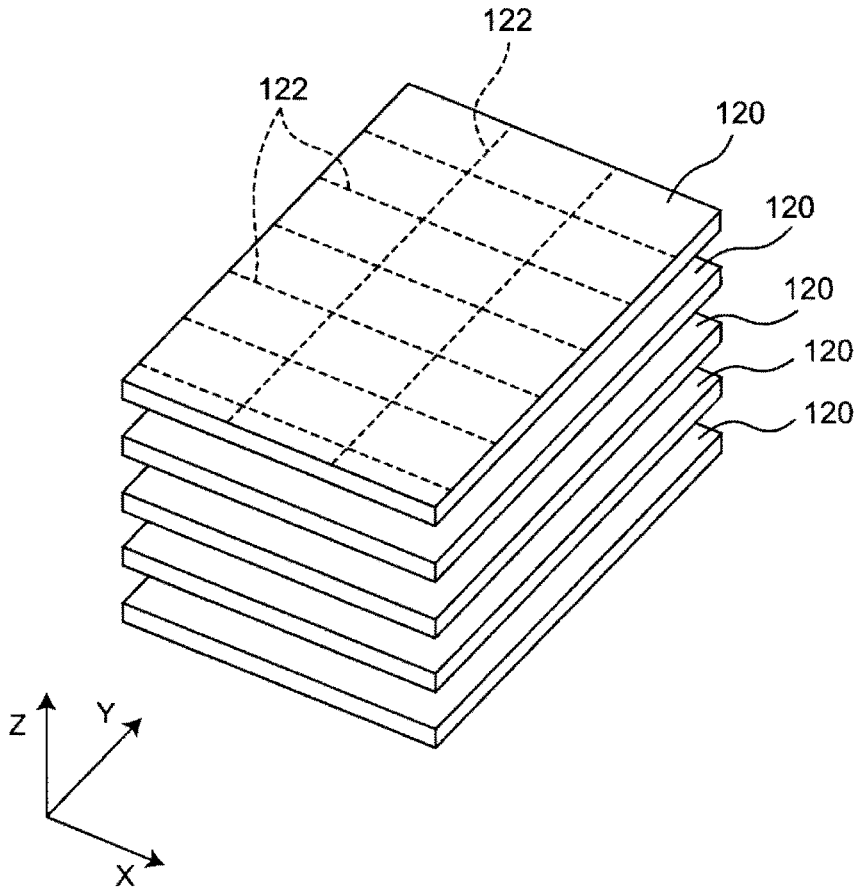
Figure 6D:
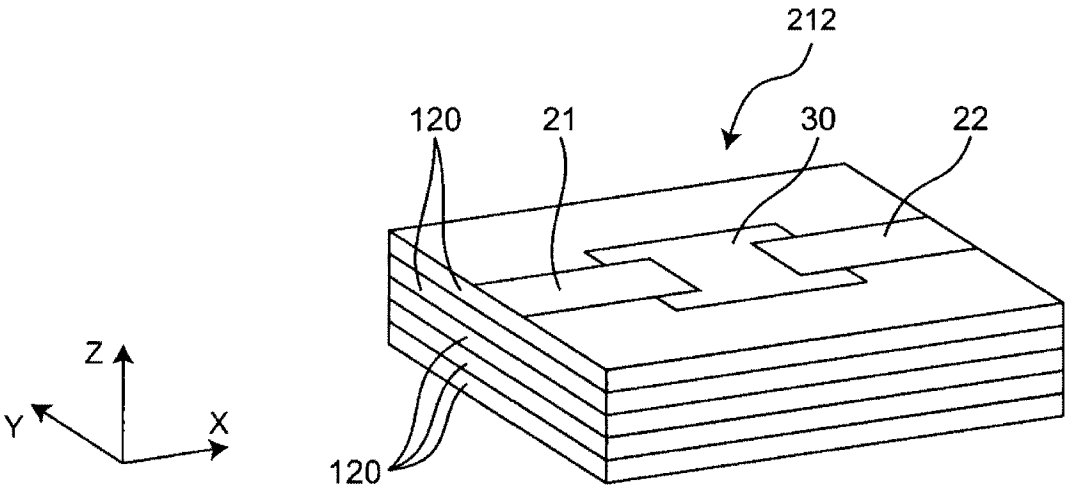

Furthermore, as shown in FIG. 6C, the plurality of second ceramic sheets 120 are laminated in the Z direction and are cut along the cut lines 122 into pieces with a size corresponding to each chip. Then, as shown in FIG. 6D, the first discharge electrode 21 and the second discharge electrode 22 are further laminated on the plurality of second ceramic sheets 120 with the size corresponding to each chip, thus preparing a second multilayer body 212. A laminating direction of the second multilayer body 212 (made up of the second ceramic sheets 120) is the Z direction.

Figure 6E:
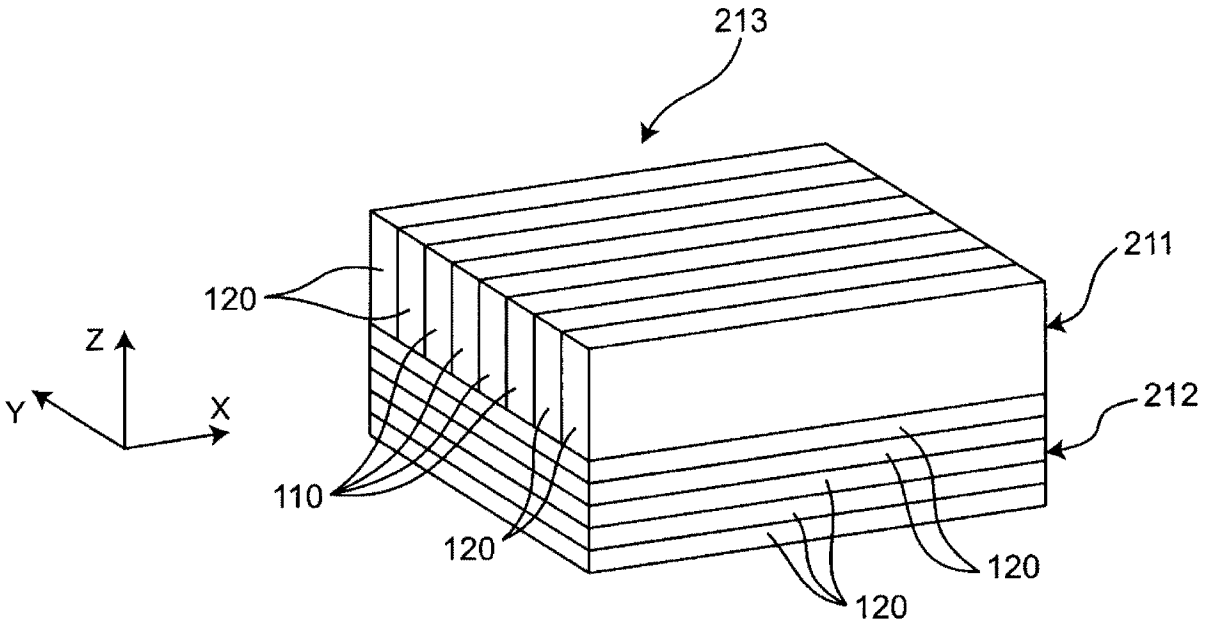

Then, as shown in FIG. 6E, one of the first multilayer body 211 and the second multilayer body 212 is placed above the other to form a third multilayer body 213. The first multilayer body 211 and the second multilayer body 212 are pressed with a die for pressure bonding. At that time, the laminating direction (Y direction) of the first multilayer body 211 and the laminating direction (Z direction) of the second multilayer body 212 are different from each other. In addition, as shown in FIG. 3, the first discharge electrode 21 and the second discharge electrode 22 are positioned to face the cavity 100.

Figure 6F:
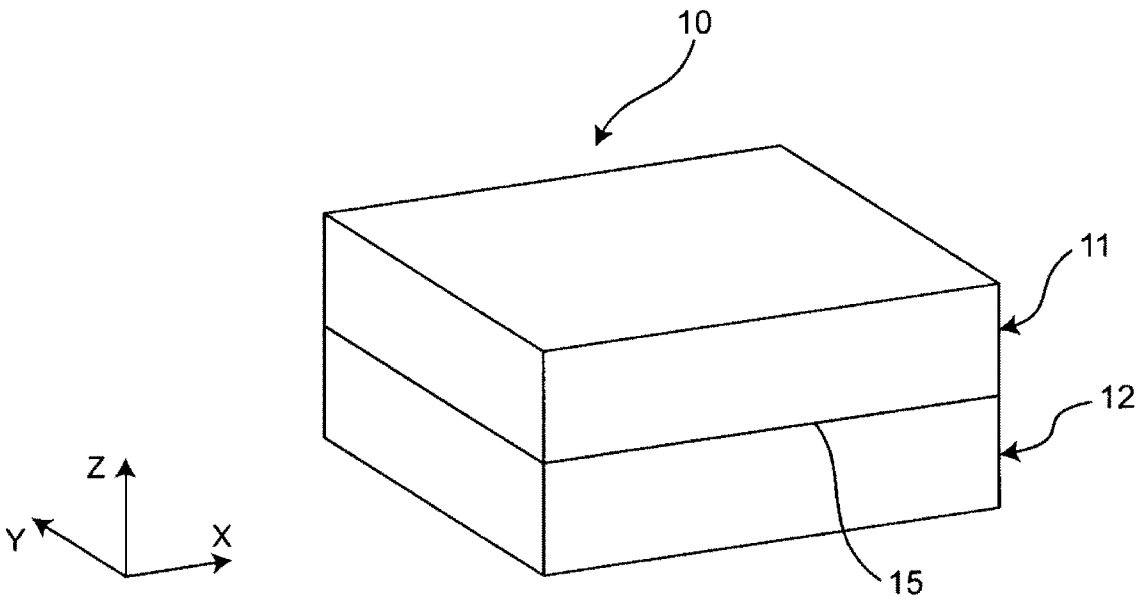

Then, the third multilayer body 213 is fired to form the bare unitary body 10 as shown in FIG. 6F. A boundary between adjacent two of the sheets 110 and 120 in the first and second multilayer bodies 211 and 212 disappears or substantially disappears with the firing. However, a boundary between the first portion 11 formed through the firing of the first multilayer body 211 and the second portion 12 formed through the firing of the second multilayer body 212 remains as the level difference interface 15. Subsequently, the first and second outer electrodes 41 and 42 are attached to the bare unitary body 10. Accordingly, the ESD protection device 1 is able to be fabricated.

According to the above-described manufacturing method for the ESD protection device 1, the first multilayer body 211 is prepared by forming the holes 111 with the same or substantially the same shape in the plurality of first ceramic sheets 110, and by laminating the plurality of first ceramic sheets 110 in a state that the holes 111 in the laminated first ceramic sheets 110 are aligned or substantially aligned with one another to form the cavity 100. As a result, the cavity 100 is able to be formed in a shape with a smooth inner surface in the laminating direction (Y direction) of the first multilayer body 211. In addition, it is possible to simply form the cavity 100 with a size that is asymmetric between one side and the other side in a direction (X direction) perpendicular or substantially perpendicular to the laminating direction (Y direction) of the first multilayer body 211.

Moreover, the third multilayer body 213 is formed by placing one of the first multilayer body 211 and the second multilayer body 212 above the other in a state that the laminating direction (Y direction) of the first multilayer body 211 and the laminating direction (Z direction) of the second multilayer body 212 are different from each other and that the first and second discharge electrodes 21 and 22 are positioned to face the cavity 100. As a result, the space of the cavity 100 on the side closer to the first discharge electrode 21 and the space of the cavity 100 on the side closer to the second discharge electrode 22 are able to be easily made different from each other.

On the other hand, in the case of setting the laminating direction of the first multilayer body and the laminating direction of the second multilayer body to be the same or substantially the same, holes of different shapes are formed in the plurality of first ceramic sheets of the first multilayer body, in order to form, in the first multilayer body, a cavity where a space on the side closer to the first discharge electrode 21 and a space on the side closer to the second discharge electrode 22 are different from each other. Hence, a difficulty arises in forming the cavity in a shape having a smooth inner surface.

Second Preferred Embodiment

Figure 7A:
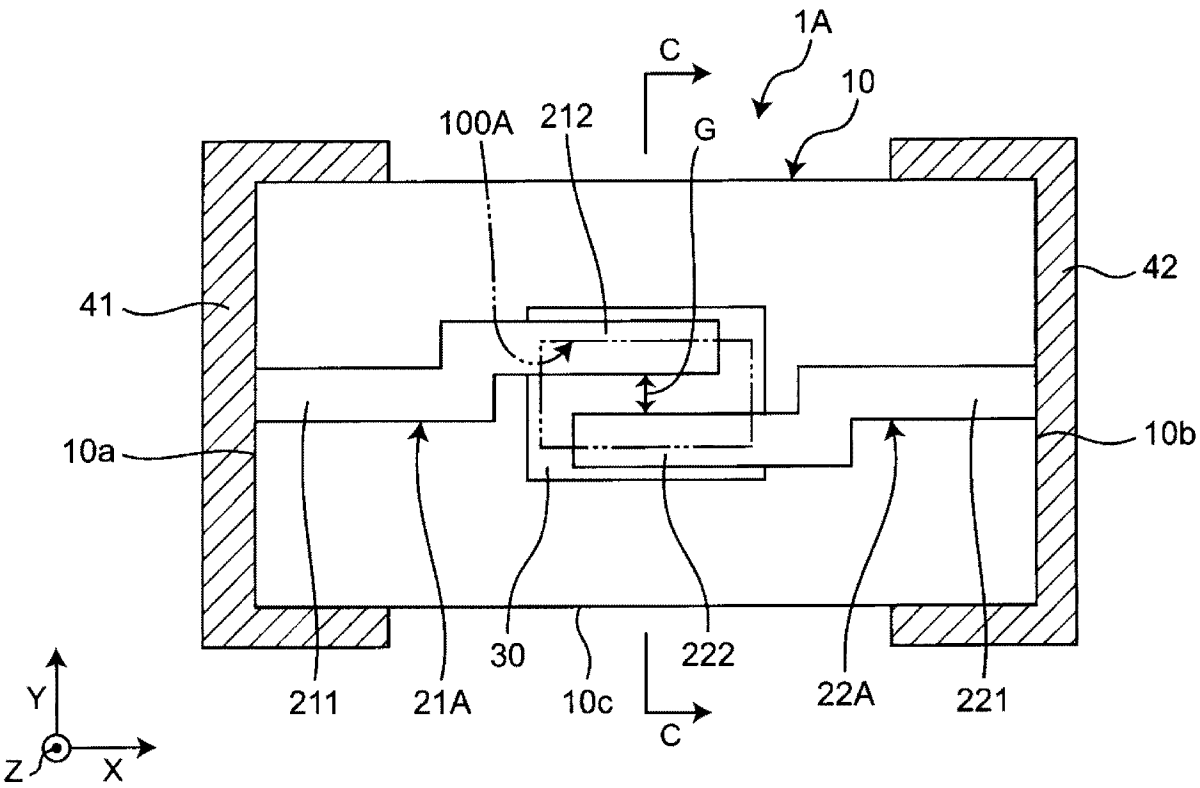
FIG. 7A is an XY sectional view showing an ESD protection device according to a second preferred embodiment of the present invention.
Figure 7B:
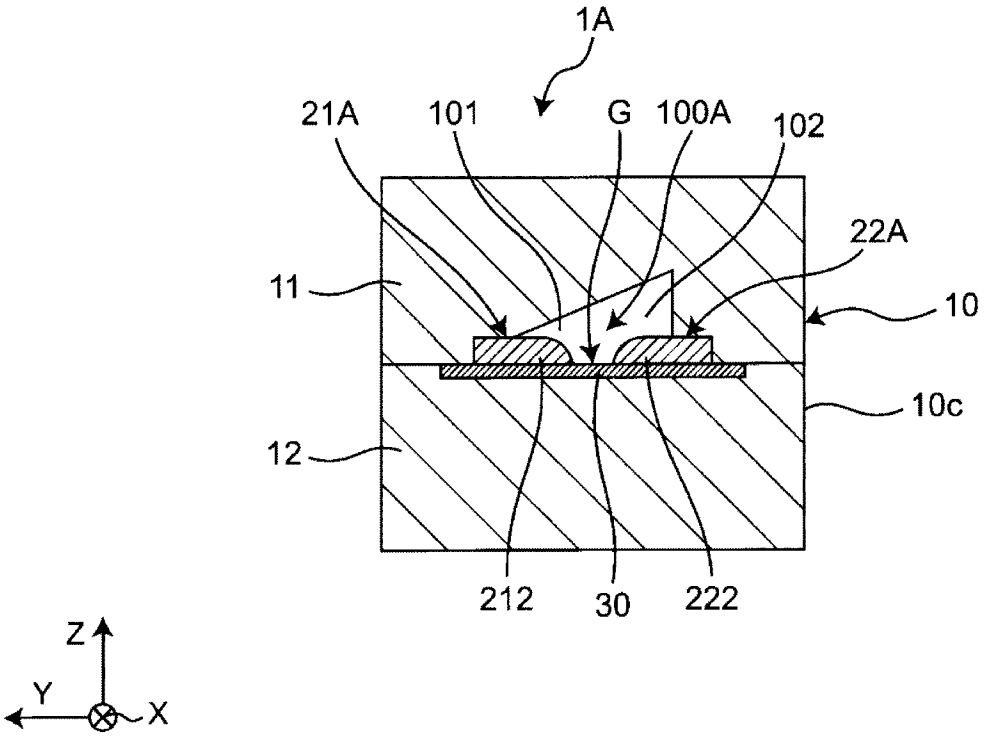
FIG. 7B is a sectional view taken along a line C-C in FIG. 7A.

FIG. 7A is an XY sectional view showing an ESD protection device according to a second preferred embodiment of the present invention. FIG. 7B is a sectional view taken along a line C-C in FIG. 7A. The second preferred embodiment is different from the first preferred embodiment in the direction in which the first discharge electrode and the second discharge electrode are opposed to each other. Only the differences between the first and second preferred embodiments are described below. It is to be noted that the same reference symbols in the second preferred embodiment as those in the first preferred embodiment denote similar elements and components to those in the first preferred embodiment, and hence description of those elements and components is omitted here.

In an ESD protection device 1A, as shown in FIGS. 7A and 7B, a direction in which a first discharge electrode 21A and a second discharge electrode 22A are opposed to each other is aligned or substantially aligned with the Y direction. Each of the first discharge electrode 21A and the second discharge electrode 22A includes a bent central portion and extends in or substantially in the X direction. A second end portion 212 of the first discharge electrode 21A and a second end portion 222 of the second discharge electrode 22A are opposed to each other in the Y direction with a gap G interposed therebetween.

A cavity 100A includes an inner surface preferably with a triangular or substantially triangular shape when viewed in a YZ section. In a vertical section (YZ section) extending in the opposing direction (Y direction) of the first discharge electrode 21A and the second discharge electrode 22A and in the height direction (Z direction) of the bare unitary body 10, a sectional area of a first space 101 of the cavity 100A on the side closer to the first discharge electrode 21A is smaller than a sectional area of a second space 102 of the cavity 100A on the side closer to the second discharge electrode 22A. Hence, the first space 101 is smaller than the second space 102.

A laminating direction of ceramic sheets (first ceramic sheets) in the first portion 11 where the cavity 100A is formed is aligned or substantially aligned with the X direction. Thus, the laminating direction (X direction) in the first portion 11 and the laminating direction (Z direction) of the second portion 12 are different from each other.

The ESD protection device 1A provides similar advantageous effects to those obtained with the ESD protection device 1 according to the first preferred embodiment.

Third Preferred Embodiment

Figure 8A:
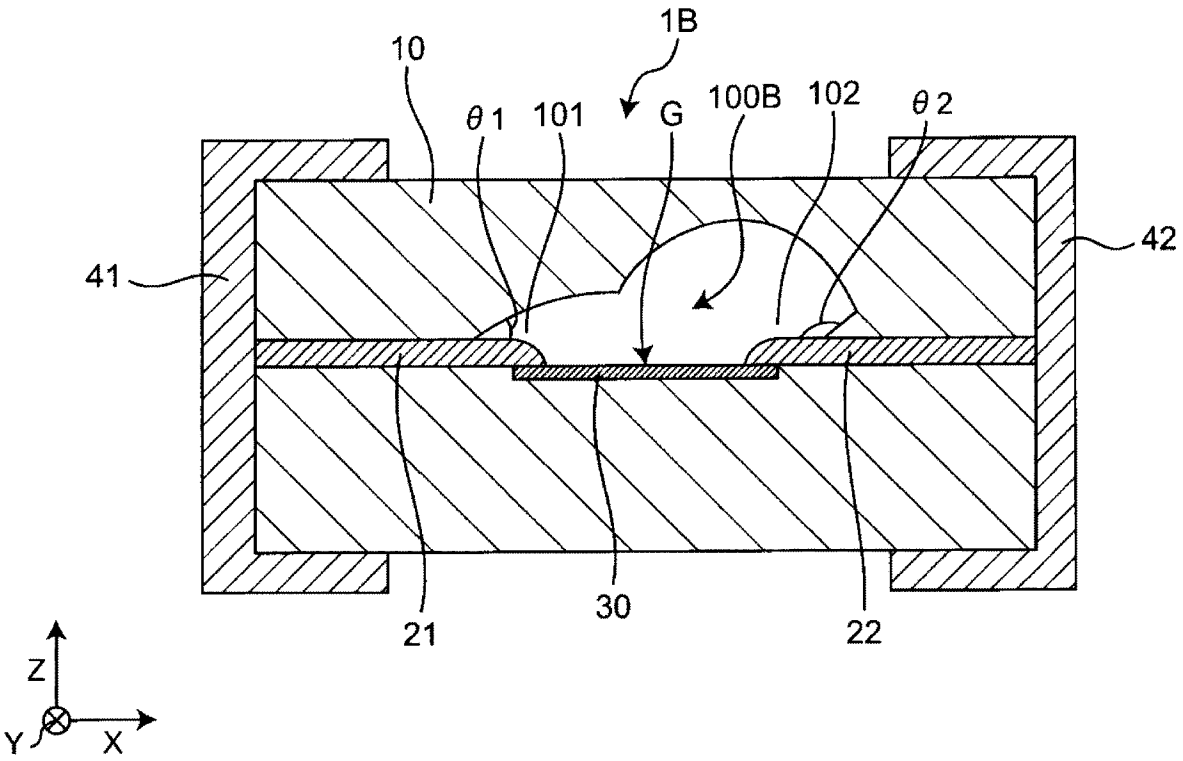
FIGS. 8A-8C are each an XZ sectional view showing an ESD protection device according to a third preferred embodiment of the present invention.
Figure 8B:
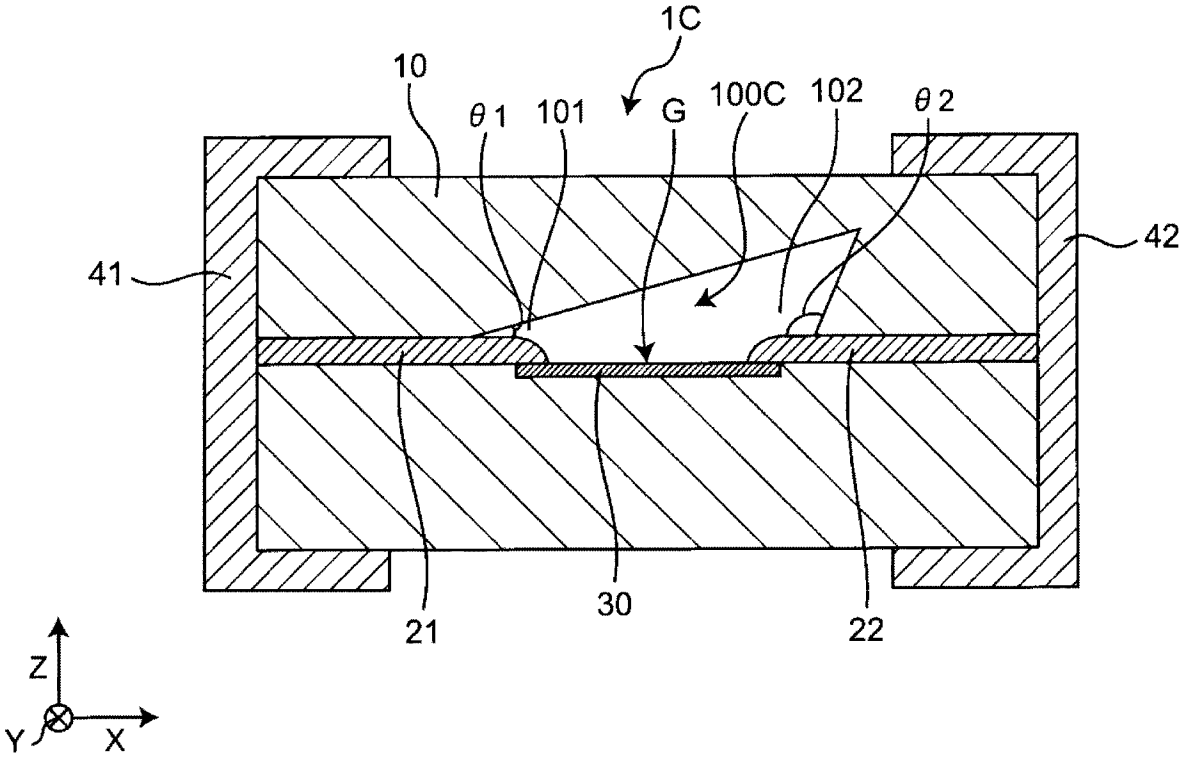
Figure 8C:
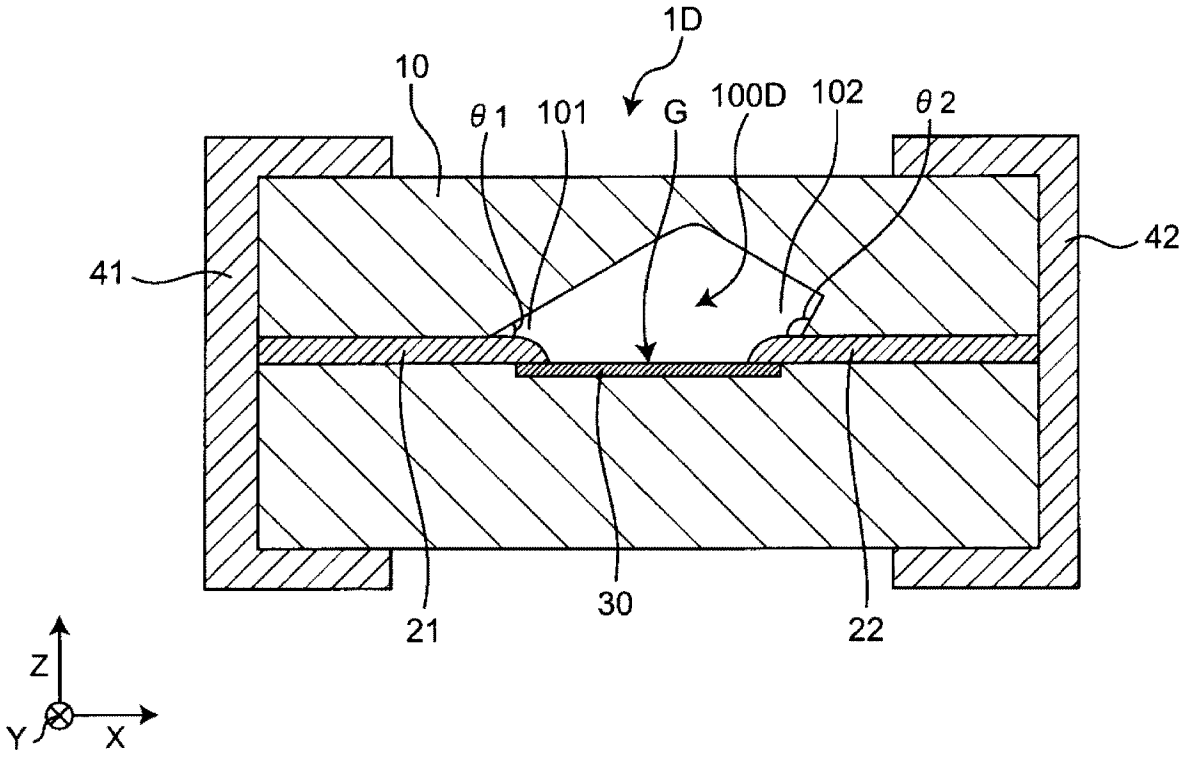

FIGS. 8A to 8C are each an XZ sectional view showing an ESD protection device according to a third preferred embodiment of the present invention. The ESD protection devices shown in FIGS. 8A to 8C are different from the first preferred embodiment in the shape of the cavity. Only the differences between the first and third preferred embodiments are described below. It is to be noted that the same reference symbols in the third preferred embodiment as those in the first preferred embodiment denote similar elements and components to those in the first preferred embodiment, and hence description of those elements and components is omitted here.

As shown in FIG. 8A, a sectional shape of a cavity 100B in an ESD protection device 1B is not triangular or substantially triangular, unlike the first preferred embodiment (FIG. 3). An inner surface defining a shape of the cavity 100B on the side closer to the first space 101 includes a circular arc surface, and an inner surface defining a shape of the cavity 100B on the side closer to the second space 102 also includes a circular arc surface. The circular arc surface on the side closer to the first space 101 is positioned at a higher level than a level on the side closer to the second space 102 in the Z direction. The first angle θ1 is an acute angle, and the second angle θ2 is an obtuse angle. Hence, the first space 101 is smaller than the second space 102.

As shown in FIG. 8B, a sectional shape of a cavity 100C in an ESD protection device 1C is triangular or substantially triangular. The first angle θ1 is an acute angle, and the second angle θ2 is an obtuse angle. Hence, the first space 101 is smaller than the second space 102.

As shown in FIG. 8C, a sectional shape of a cavity 100D in an ESD protection device 1D is not triangular or substantially triangular, unlike the first preferred embodiment (FIG. 3). An inner surface defining a shape of the cavity 100D on the side closer to the first space 101 includes an inclined surface, and an inner surface defining a shape of the cavity 100D on the side closer to the second space 102 also includes an inclined surface. The inclined surface on the side closer to the first space 101 and the inclined surface on the side closer to the second space 102 intersect at a point above the gap G. The first angle θ1 is an acute angle, and the second angle θ2 is an obtuse angle. Hence, the first space 101 is smaller than the second space 102.

The ESD protection devices 1B to 1D provide similar advantageous effects to those obtained with the ESD protection device 1 according to the first preferred embodiment.

It is to be noted that the preferred embodiments of the present invention are not limited to the specific preferred embodiments described above, and the preferred embodiments of the present invention is able to be modified in design within the scope not departing from the gist of the present invention. For example, the features of the first to third preferred embodiments may be combined with each other in various ways.

While, in the above preferred embodiments, the first angle is preferably smaller than the second angle, the first angle may be larger than or equal to the second angle insofar as the first space is smaller than the second space, for example.

While, in the above preferred embodiments, the level difference interface preferably is provided at the joined boundary between the first portion and the second portion, the level difference interface may be omitted, for example.

While, in the above preferred embodiments, the discharge auxiliary electrode is disposed inside the bare unitary body, the discharge auxiliary electrode may be omitted from the bare unitary body, for example. While the bare unitary body is described as preferably having a rectangular parallelepiped or substantially rectangular parallelepiped shape, it may instead have a circular columnar shape, for example.

While, in the above preferred embodiments, the third multilayer body is preferably formed by placing one of the first multilayer body and the second multilayer body above the other in a state that the laminating direction of the first multilayer body and the laminating direction of the second multilayer body are different from each other, the third multilayer body may be formed by placing one of the first multilayer body and the second multilayer body above the other in a state that the laminating direction of the first multilayer body and the laminating direction of the second multilayer body are the same or substantially the same, for example. In such a case, in the first multilayer body, holes with different shapes are formed in the plurality of first ceramic sheets.

While, in the above preferred embodiments, the holes corresponding to a plurality of chips are preferably formed in one first ceramic sheet, the hole corresponding to only one chip may be formed in one first ceramic sheet, for example.

Example

A non-limiting example of a manufacturing method for the ESD protection device according to the first preferred embodiment is described below.

(1) Preparation of Ceramic Sheet

A material including Ba, Al, and Si as main components (that is, a BAS material) was included as a ceramic material for the ceramic sheet. Individual raw materials were prepared and mixed to provide a predetermined composition and were calcined at about 800° C. to about 1000° C. Calcined powder thus obtained was pulverized for about 12 hours by a zirconia ball mill, and a ceramic powder was obtained. Organic solvents, for example, toluene and Ekinen, were added to and mixed with the obtained ceramic powder. A binder and a plasticizer were further added and mixed to obtain slurry. The slurry thus obtained was shaped by a doctor-blade method, and a ceramic sheet with a thickness of about 50 μm was obtained.

(2) Preparation of Paste Materials for Electrode Printing (2-1) Preparation of Paste for Discharge Auxiliary Electrode A mixed paste used to form the discharge auxiliary electrode was obtained by preparing CuAl alloy powder with an average particle size of about 2.5 μm and calcined powder including a $BaO—SiO_2—Al_2O_3$ glass ceramic powdery material and with an average particle size of about 1 μm at a predetermined ratio, adding a binder resin and a solvent, and then agitating and mixing them with three rolls. The mixed paste was composed of about 20 wt % of the binder resin and the solvent, and remaining about 80 wt % of the CuAl alloy powder and the calcined powder of the BAS material.

(2-2) Preparation of Paste for Discharge Electrodes

A paste for the discharge electrodes was obtained by preparing about 40% by weight of Cu powder with an average particle size of about 1 μm, about 40% by weight of Cu powder with an average particle size of about 3 μm, and about 20% by weight of an organic vehicle, which was prepared by dissolving ethyl cellulose in terpineol, and by mixing them with three rolls.

(2-3) Preparation of Paste for Outer Electrodes

A paste for the outer electrodes was obtained by preparing about 80% by weight of Cu powder with an average particle size of about 1 μm, about 5% by weight of borosilicate alkaline glass frit with a transition point of about 620° C., a softening point of about 720° C., and an average particle size of about 1 μm, and about 15% by weight of an organic vehicle, which was prepared by dissolving ethyl cellulose in terpineol, and by mixing them with three rolls.

(3) Formation of Discharge Electrodes, Discharge Auxiliary Electrode, and Cavity An ESD protection device was fabricated by separating the device into two parts, i.e., the first multilayer body and the second multilayer body.

(3-1) Fabrication of First Multilayer Body

The ceramic sheet prepared in above (1) was punched by a die formed corresponding to the desired shape of the cavity. Dimensions of the cavity are able to be determined depending on the shape to be punched, the thickness of the ceramic sheet, and the number of the ceramic sheets to be laminated. Here, the cavity was formed by punching five ceramic sheets, each having the thickness of about 50 μm, with a die in the form of a right triangle or a substantially right triangle (see FIG. 3) having a horizontal size of about 140 μm and a vertical size of about 30 μm. The first multilayer body was fabricated by laminating and pressing the punched ceramic sheets according to a desired chip size, and by cutting the laminated ceramic sheets into individual pieces, each having a desired chip shape, with a micro-cutter. The chip shape had dimensions of about 1.0 (X direction)×about 0.5 (Y direction)×about 0.25 (Z direction) mm.

(3-2) Fabrication of Second Multilayer Body

The ceramic sheet prepared in above (1) was laminated in plural number, the paste for the discharge auxiliary electrode was coated thereon, and the paste for the discharge electrodes was further coated thereon. Here, a width of each of the first and second discharge electrodes was set to about 50 μm, and a gap between the first and second discharge electrodes was set to about 20 μm. The second multilayer body was fabricated by laminating and pressing the ceramic sheets in match with a desired chip size, and by cutting the laminated ceramic sheets into individual pieces, each having a desired chip shape, with a micro-cutter. The chip shape had dimensions of about 1.0 (X direction)×about 0.5 (Y direction)×about 0.25 (Z direction) mm.

(4) Fabrication of Third Multilayer Body

The third multilayer body was fabricated by pressing the first multilayer body and the second multilayer body, which were fabricated in above (3), with a die for pressure bonding.

(5) Firing

The third multilayer body was fired in an $N_2$ atmosphere. If the electrode material is not oxidized in the $N_2$ atmosphere, the third multilayer body may be fired in an air atmosphere, for example.

(6) Fabrication of Outer Electrodes

After the firing, the outer electrodes were formed by coating the paste for the outer electrodes on both the end surfaces of the bare unitary body, and by baking the paste.

(7) Plating

Electrolytic Ni—Sn plating was performed on the outer electrodes.

(8) Completion

The ESD protection device was completed through the above-described processes. It is to be noted that the ceramic material included in the ceramic sheets is not particularly limited to the above-mentioned material, and another component may be added, for example, by adding glass to forsterite or adding glass to $CaZrO_3$. Furthermore, the electrode material is not limited to only Cu, and may be Ag, Pd, Pt, Al, Ni, W, or a combination of those elements, for example.

Experimental Results

The following Table 1 lists experimental results of characteristics of a related-art structure and first to third structures according to a preferred embodiment of the present invention.

TABLE 1

| | Discharge | Discharge Start Voltage | | | | |
|---|---|---|---|---|---|---|
| | Gap | 2 kV | 3 kV | 4 kV | 6 kV | 8 kV |
| Related-Art Structure | about 20 μm | x | x | ○ | ○ | ○ |
| First Structure (first angle is about 30° and second angle is about 75°) | about 20 μm | x | Δ | ○ | ○ | ○ |
| Second Structure (first angle is about 30° and second angle is about 90°) | about 20 μm | x | ○ | ○ | ○ | ○ |
| Third Structure (first angle is about 30° and second angle is about 150°) | about 20 μm | ○ | ○ | ○ | ○ | ○ |

In the related-art structure, the first angle and the second angle of the cavity are the same or substantially the same. In the first structure of a preferred embodiment of the present invention, the first angle is about 30° and the second angle is about 75°, for example. In the second structure of a preferred embodiment of the present invention, the first angle is about 30° and the second angle is about 90°, for example. In the third structure of a preferred embodiment of the present invention, the first angle is about 30° and the second angle is about 150°, for example. The discharge gap refers to the gap between the first and second discharge electrodes, and it is about 20 μm, for example.

Regarding the related-art structure and the first to third structures, an operation rate was examined when the discharge start voltage was changed. A mark "○" represents the operation rate of 80 about % to about 100%, "Δ" represents the operation rate of about 40% to about 80%, and "X" represents the operation rate of about 0% to about 40%.

As shown in Table 1, the discharge start voltage gradually lowers in the order of the first to third structures. That is, as the difference between the first angle and the second angle increases, the discharge start voltage is reduced. The reason is that, as the difference between the first angle and the second angle increases, inequality of the electric field increases between the first space and the second space of the cavity and the discharge occurs at a lower voltage.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An ESD protection device comprising:

a body including a cavity; and a first discharge electrode and a second discharge electrode that are located inside the body; wherein the first discharge electrode and the second discharge electrode are opposed to each other with a gap located therebetween;

the gap between the first discharge electrode and the second discharge electrode is located in the cavity of the body;

the first discharge electrode and the second discharge electrode are exposed to the cavity of the body;

the cavity includes a first space located on a side of the cavity closer to the first discharge electrode and a second space located on a side of the cavity closer to the second discharge electrode;

the first space of the cavity is smaller than the second space of the cavity; and a degree of concentration of an electric field in the first space is larger than a degree of concentration of an electric field in the second space.

2. The ESD protection device according to claim 1, wherein a length of the first space in a height direction of the body is smaller than a length of the second space in the height direction of the body.

3. The ESD protection device according to claim 1, wherein in a vertical section extending in a direction in which the first discharge electrode and the second discharge electrode are opposed to each other and in a height direction of the body:

the first space includes a first sectional area surrounded by an inner surface of the cavity, an outer surface of the first discharge electrode, and a first linear line that contacts an end portion of the first discharge electrode on a side closer to the second discharge electrode and that extends in the height direction; and the second space includes a second sectional area surrounded by the inner surface of the cavity, an outer surface of the second discharge electrode, and a second linear line that contacts an end portion of the second discharge electrode on a side closer to the first discharge electrode and that extends in the height direction; and the first sectional area of the first space is smaller than a second sectional area of the second space.

4. The ESD protection device according to claim 3, wherein, in the vertical section, a first angle defined by the inner surface of the cavity and the outer surface of the first discharge electrode is smaller than a second angle defined by the inner surface of the cavity and the outer surface of the second discharge electrode.

5. The ESD protection device according to claim 4, wherein the first angle is an acute angle, and the second angle is 90° or substantially 90°, or an obtuse angle.

6. The ESD protection device according to claim 1, wherein the body includes a first portion in which the cavity is located and a second portion which is joined with the first portion and in which the first discharge electrode and the second discharge electrode are located; and a level difference interface is located at a joined boundary between the first portion and the second portion.

7. The ESD protection device according to claim 1, wherein each of the first discharge electrode and the second discharge electrode has a strip shape.

8. The ESD protection device according to claim 1, wherein an inner surface of the cavity has a shape of a triangular or substantially triangular prism.

9. The ESD protection device according to claim 1, wherein a first end portion of the first discharge electrode is exposed at a first end surface of the body and a second end portion of the first discharge electrode is located inside the body.

10. The ESD protection device according to claim 1, wherein an end portion of the first discharge electrode is exposed at a first end surface of the body; and an end portion of the second discharge electrode is exposed at a second end surface of the body that opposes the first end surface of the body.

11. The ESD protection device according to claim 1, further comprising a discharge auxiliary electrode that electrically connects the first discharge electrode to the second discharge electrode.

12. The ESD protection device according to claim 11, wherein the discharge auxiliary electrode at least partially overlaps the gap between the first discharge electrode and the second discharge electrode.

13. The ESD protection device according to claim 11, wherein the discharge auxiliary electrode has a rectangular or substantially rectangular shape.

14. The ESD protection device according to claim 11, wherein a size of the cavity in a width direction of the body is the same or substantially the same as a size of the discharge auxiliary electrode in the width direction.

15. The ESD protection device according to claim 11, wherein a size of the cavity in a length direction of the body is larger than a size of the discharge auxiliary electrode in the length direction.

16. The ESD protection device according to claim 1, further comprising a first outer electrode and a second outer electrode located on an outer surface of the body.

17. The ESD protection device according to claim 16, wherein the first discharge electrode is electrically connected to the first outer electrode, and the second discharge electrode is electrically connected to the second outer electrode.

18. An electronic device, comprising:

a first terminal; and the ESD protection device according to claim 16; wherein the first outer electrode is electrically connected to the first terminal and the second outer electrode is connected to ground.

* * * * *